US010881165B2

(12) United States Patent
Chang et al.

(10) Patent No.: US 10,881,165 B2
(45) Date of Patent: Jan. 5, 2021

(54) ZIPPER-FREE MOISTURE-PERMEABLE WATERPROOF HIGH-TOP SHOE

(71) Applicants: Chung-Hao Chang, Taichung (TW); Chia-Ying Chang, Taichung (TW)

(72) Inventors: Chung-Hao Chang, Taichung (TW); Chia-Ying Chang, Taichung (TW)

( * ) Notice: Subject to any disclaimer, the term of this patent is extended or adjusted under 35 U.S.C. 154(b) by 61 days.

(21) Appl. No.: 16/426,653

(22) Filed: May 30, 2019

(65) Prior Publication Data

US 2020/0323304 A1 Oct. 15, 2020

(30) Foreign Application Priority Data

Apr. 12, 2019 (TW) ..... 108204549 U

(51) Int. Cl.
*A43B 23/02* (2006.01)
*A43B 7/12* (2006.01)
*A43C 9/00* (2006.01)

(52) U.S. Cl.
CPC ..... *A43B 7/125* (2013.01); *A43B 23/0205* (2013.01); *A43C 9/00* (2013.01)

(58) Field of Classification Search
CPC ..... A43B 7/12; A43B 7/125; A43B 23/0205; A43B 23/0235
See application file for complete search history.

(56) References Cited

U.S. PATENT DOCUMENTS 5,738,937 A * 4/1998 Baychar ..... A43B 5/0405 428/316.6
6,048,810 A * 4/2000 Baychar ..... A41D 27/02 36/117.3
6,935,053 B2 * 8/2005 Wiener ..... A43B 7/125 36/14
8,176,659 B2 * 5/2012 von Blucher ..... B32B 27/08 36/113
8,569,190 B2 * 10/2013 Baychar ..... A43B 1/0045 442/131
8,984,776 B2 * 3/2015 Ludemann ..... B29D 35/02 36/109
10,470,517 B2 * 11/2019 Chang ..... A43B 13/32
2018/0343972 A1 * 12/2018 Wang ..... A43B 7/12
2018/0352905 A1 * 12/2018 Chang ..... A43B 23/0235
2020/0214393 A1 * 7/2020 Chang ..... A43B 23/0235

* cited by examiner

*Primary Examiner* — Jila M Mohandesi
(74) *Attorney, Agent, or Firm* — Hamre, Schumann, Mueller & Larson, P.C.

(57) ABSTRACT

A zipper-free moisture-permeable waterproof high-top shoe includes a high-top inner sock body having a first foot portion and a first leg portion cooperating with each other to define a foot space. A moisture-permeable waterproof high-top shoe-like sleeve is sleeved on the high-top inner sock body and has a second foot portion. A moisture-permeable waterproof low-top shoe-like sleeve is sleeved on the second foot portion and has a sleeve body. A high-top outer sock body is sleeved on an assembly of the inner sock body, the high-top shoe-like sleeve and the low-top shoe-like sleeve, and has a third foot portion. A sole is fixed to a bottom portion of the third foot portion.

9 Claims, 9 Drawing Sheets

ZIPPER-FREE MOISTURE-PERMEABLE WATERPROOF HIGH-TOP SHOE

CROSS-REFERENCE TO RELATED APPLICATION

This application claims priority of Taiwanese Patent Application No. 108204549, filed on Apr. 12, 2019.

FIELD

The disclosure relates to a shoe, more particularly to a zipper-free moisture-permeable waterproof high-top shoe.

BACKGROUND

A conventional waterproof high-top shoe is usually provided with a side zipper to facilitate wearing and removal thereof. Although the provision of the side zipper can facilitate wearing and removal of the high-top shoe, it can adversely affect the waterproof function of the conventional waterproof high-top shoe since water seepage is likely to occur through the teeth of the side zipper. Moreover, the provision of the side zipper may also have an adverse effect on the comfort of wearing the conventional waterproof high-top shoe.

SUMMARY

Therefore, an object of the present disclosure is to provide a zipper-free moisture-permeable waterproof high-top shoe that is capable of alleviating at least one of the drawbacks of the prior art.

Accordingly, a zipper-free moisture-permeable waterproof high-top shoe of this disclosure includes a high-top inner sock body, a moisture-permeable waterproof high-top shoe-like sleeve, a moisture-permeable waterproof low-top shoe-like sleeve, a high-top outer sock body, and a sole. The high-top inner sock body includes a first foot portion, and a first leg portion extending upwardly from and cooperating with the first foot portion to define a foot space having a top opening. The high-top shoe-like sleeve is sleeved on the high-top inner sock body, and includes a second foot portion corresponding to the first foot portion, and a second leg portion extending upwardly from the second foot portion and corresponding to the first leg portion.

The low-top shoe-like sleeve is sleeved on the second foot portion, and includes a sleeve body made from at least one cut piece which includes a lining layer, an outer fabric layer, an upright velvet layer and a moisture-permeable waterproof layer. The lining layer serves as an inner surface of the sleeve body, and is connected to an outer surface of the second foot portion. The upright velvet layer has a plurality of spaced-apart pile yarns woven between the lining layer and the outer fabric layer. The moisture-permeable waterproof layer serves as an outer surface of the sleeve body, and is fixed to an outer surface of the outer fabric layer. The high-top outer sock body is sleeved on an assembly of the high-top inner sock body, the high-top shoe-like sleeve and the low-top shoe-like sleeve, and includes a third foot portion corresponding to the second foot portion, and a third leg portion extending upwardly from the third foot portion and corresponding to the second leg portion. The sole is fixed to a bottom portion of the third foot portion.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
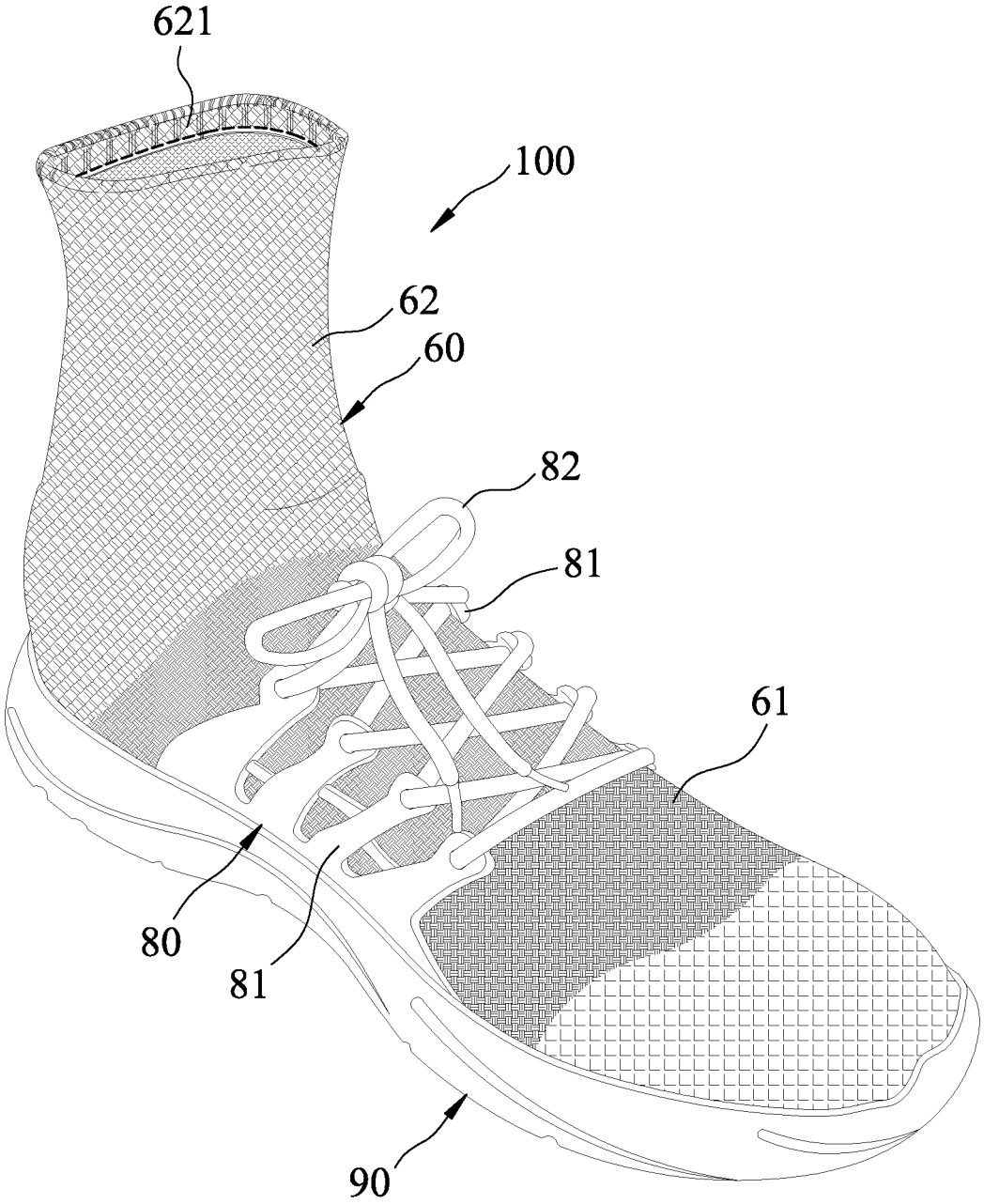
FIG. 1 is a perspective view of a zipper-free moisture-permeable waterproof high-top shoe according to the embodiment of the present disclosure.

Referring to FIGS. 1 to 4, a zipper-free moisture-permeable waterproof high-top shoe 100 according to the embodiment of the present disclosure is shown to comprise a high-top inner sock body 10, a moisture-permeable waterproof high-top shoe-like sleeve 20, a first connecting layer 30, a moisture-permeable waterproof low-top shoe-like sleeve 40, a second connecting layer 50, a high-top outer sock body 60, a third connecting layer 70, a tightening unit 80, a sole 90 and an adhesive layer 91.

The high-top inner sock body 10 includes a first foot portion 11, and a first leg portion 12 extending upwardly from the first foot portion 11 and cooperating with the same to define a foot space 13 having a top opening. The first leg portion 12 has a first top end 121 defining the top opening of the foot space 13. In this embodiment, the high-top inner sock body 10 is a woven sock, but is not limited thereto.

The moisture-permeable waterproof high-top shoe-like sleeve 20 is sleeved on the high-top inner sock body 10, and includes a second foot portion 21 corresponding to the first foot portion 11, and a second leg portion 22 extending upwardly from the second foot portion 21 and corresponding to the first leg portion 12. The second leg portion 22 has a second top end 221 corresponding to the first top end 121. In this embodiment, the high-top shoe-like sleeve 20 is made of polyurethane (PU), but is not limited thereto.

The first connecting layer 30 is fixed between an outer surface of the high-top inner sock body 10 and an inner surface of the high-top shoe-like sleeve 20. In this embodiment, the first connecting layer 30 is hot-melt adhesive, and is sprayed completely on the outer surface of the high-top inner sock body 10 and the inner surface of the high-top shoe-like sleeve 20. In other variations of this embodiment, the first connecting layer 30 may be sprayed partially on the outer surface of the high-top inner sock body 10 and the inner surface of the high-top shoe-like sleeve 20, or coated on the outer surface of the high-top inner sock body 10 and the inner surface of the high-top shoe-like sleeve 20 by glue dispensing.

The moisture-permeable waterproof low-top shoe-like sleeve 40 is sleeved on the second foot portion 21, and includes a sleeve body 41 and a waterproof unit 42.

The sleeve body 41 is made from a cut piece 410 (see FIGS. 4 and 6) which includes a lining layer 411, an outer fabric layer 412, an upright velvet layer 413 and a moisture-permeable waterproof layer 414. The upright velvet layer 413 has a plurality of spaced-apart pile yarns 415 woven between the lining layer 411 and the outer fabric layer 412. The lining layer 411 serves as an inner surface of the sleeve body 41, and is connected to an outer surface of the second foot portion 21. The moisture-permeable waterproof layer 414 serves as an outer surface of the sleeve body 41, and is fixed to an outer surface of the outer fabric layer 412. In this embodiment, the moisture-permeable waterproof layer 414 is made of polyurethane (PU), but is not limited thereto. In other embodiment, the moisture-permeable waterproof layer 414 may be made of thermoplastic polyurethane (TPU), polyethylene (PE), polytetrafluoroethylene (PTFE), polypropylene (PP) or thermo-plastic polyester elastomer (TPEE). Moreover, the moisture-permeable waterproof layer 414 has a water resistance that is not less than hydrostatic pressure of 3000 mm $H_2O$ under the waterproof standard test method of Japanese JIS L1092B, and a moisture permeability that is not less than 3000 $g/m^2/24$ hr under the hygroscopic standard test method of Japanese JIS L1099B1. Thus, the moisture-permeable waterproof layer 414 has waterproof and moisture-permeable effect.

Figure 6:
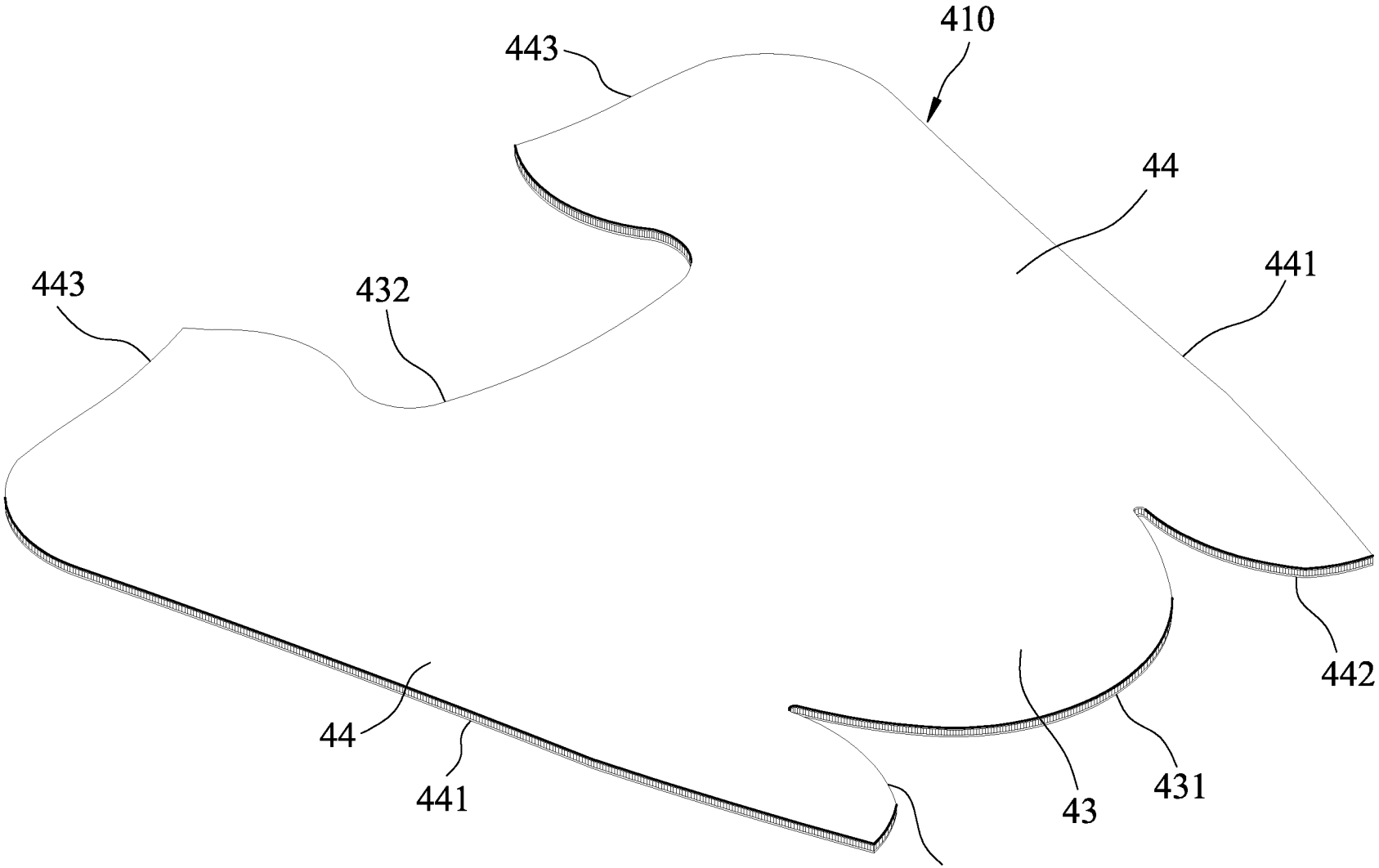
FIG. 6 is a perspective view of a cut piece from which a sleeve body of a low-top shoe-like sleeve of the embodiment is made.
Figure 7:
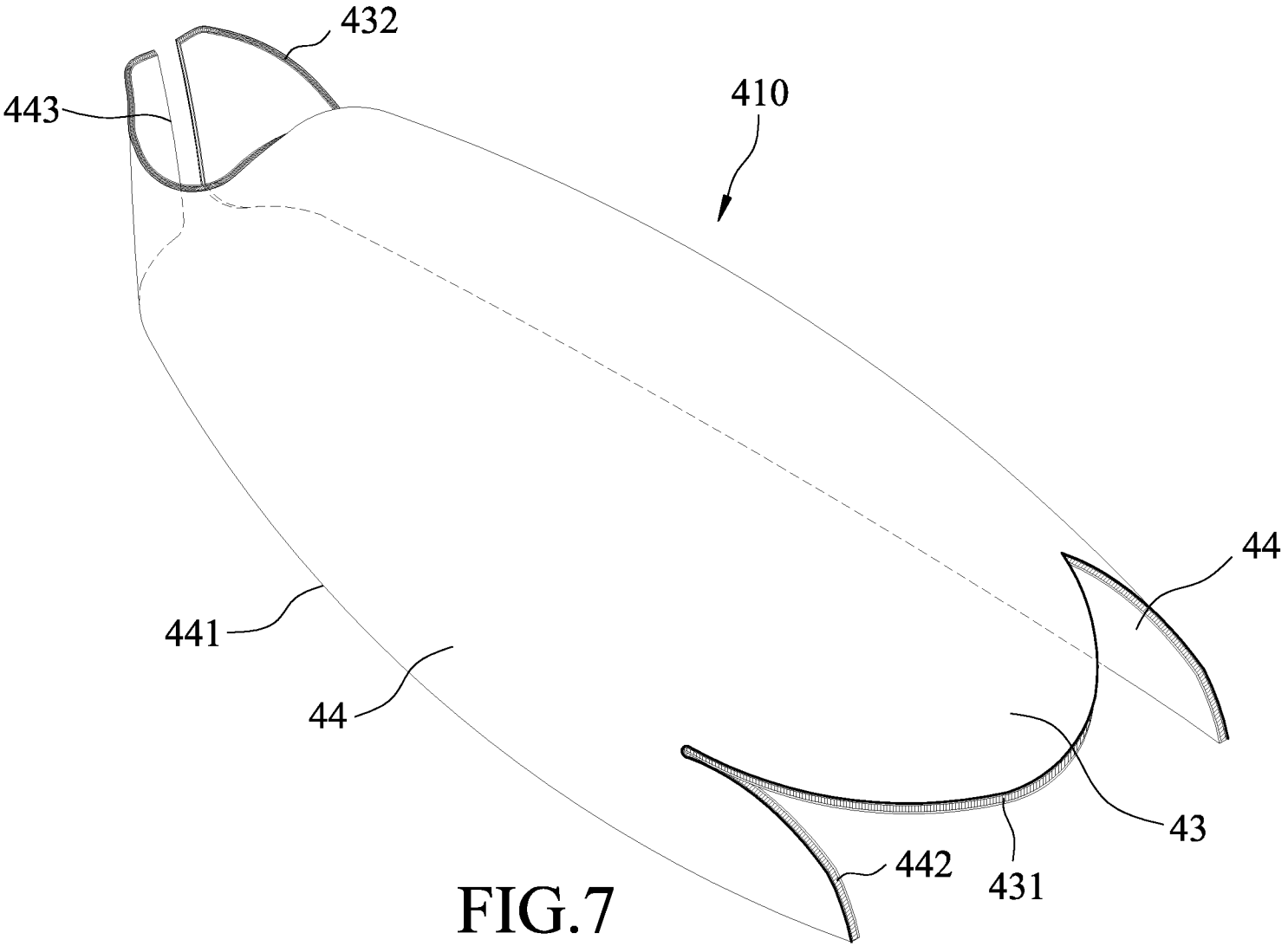
FIG. 7 illustrates how the cut piece can be folded to form the sleeve body of the low-top shoe-like sleeve of the embodiment.

Referring to FIGS. 6 and 7, the cut piece 410 has a main body 43, and two wing portions 44 symmetrically disposed on two opposite sides of the main body 43 and integrally connected as one piece with the main body 43. The main body 43 has a front convex portion 431 and a rear concave portion 432 opposite to the front convex portion 431. Each of the front convex portion 431 and the rear concave portion 432 has two opposite ends.

Each wing portion 44 includes a wing lateral edge 441 spaced apart from the main body 43 and having a front end and a rear end, a front curved edge 442 connected between the front end of the wing lateral edge 441 and a corresponding one of the ends of the front convex portion 431, and a rear mating edge 443 connected between the rear end of the wing lateral edge 441 and a corresponding one of the ends of the rear concave portion 432.

Figure 8:
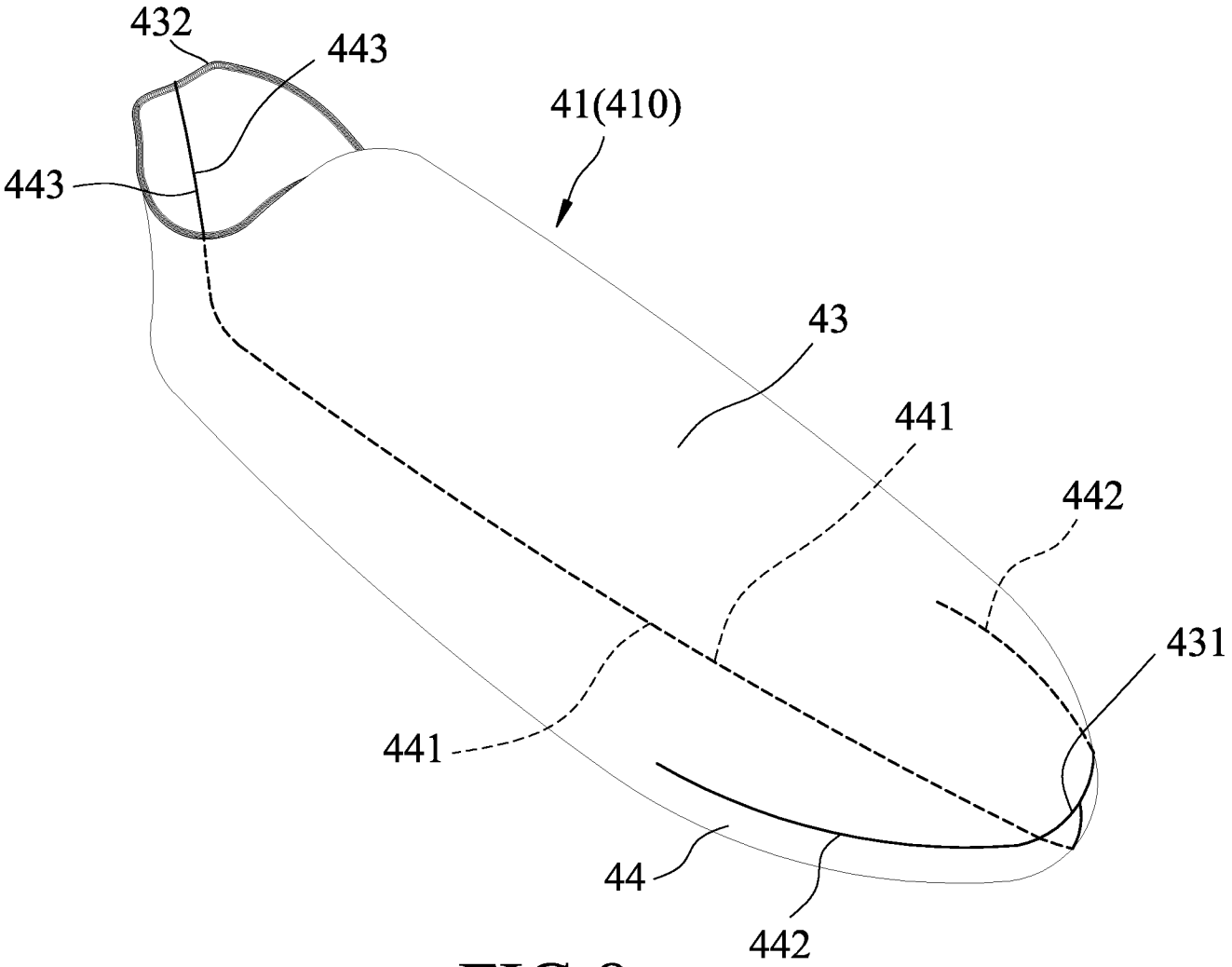
FIG. 8 illustrates how the cut piece is sewn to form the sleeve body of the low-top shoe-like sleeve of the embodiment.
Figure 9:
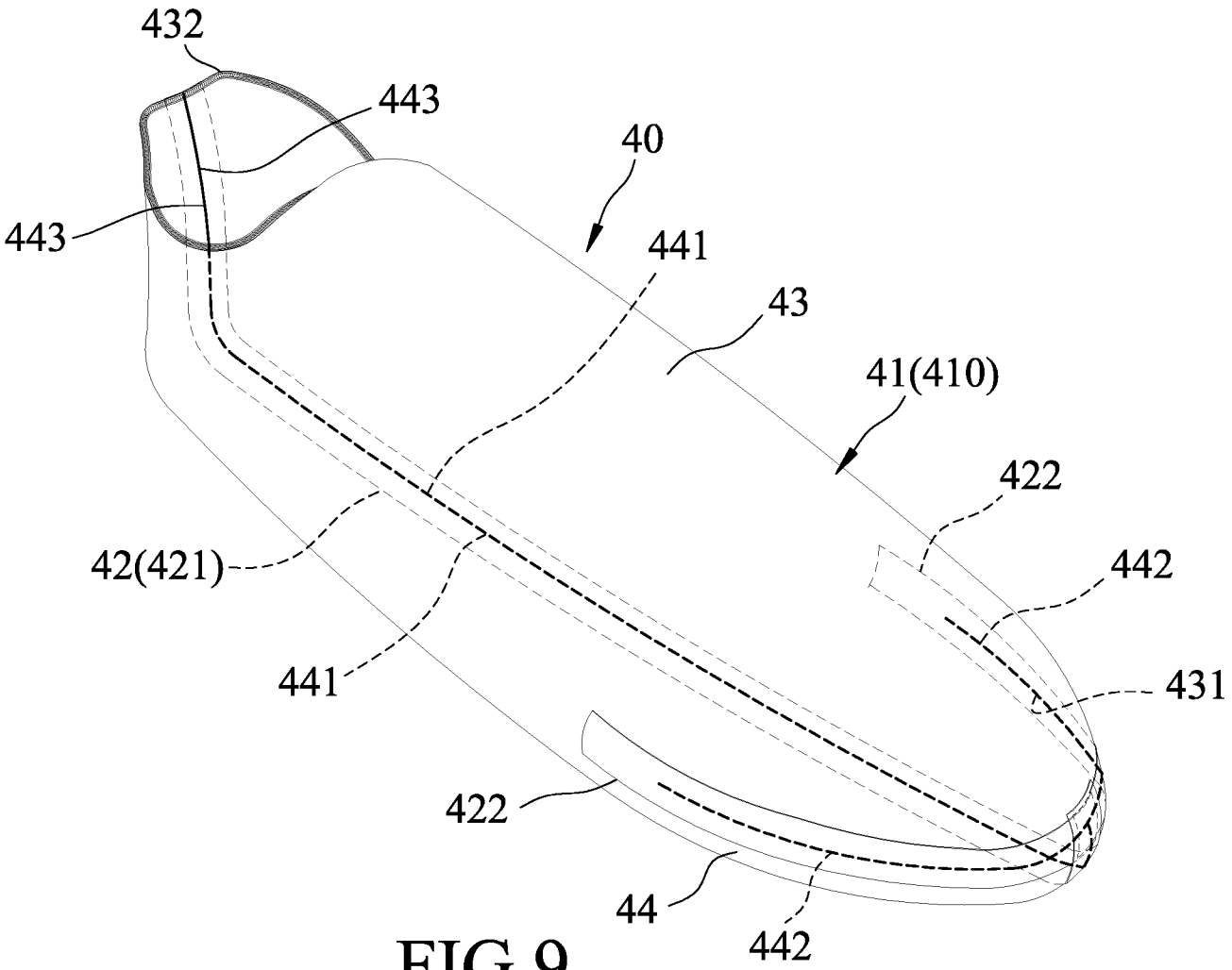
FIG. 9 is a view similar to FIG. 8, but illustrating how a waterproof unit of the low-top shoe-like sleeve covers the seams of the sleeve body.

Referring to FIGS. 8 and 9, in combination with FIG. 7, the front curved edges 442 of the wing portions 44 are connected to a periphery of the front convex portion 431 of the main body 43 by sewing, the wing lateral edges 441 of the wing portions 44 are connected to each other by sewing, and the rear mating edges 443 of the wing portions 41 are also connected to each other by sewing, thereby forming the sleeve body 41. In this embodiment, the front curved edge 442 of each wing portion 44 has an arc length substantially equal to one half of the arc length of the front convex portion 431.

It should be noted herein that, in other variations of this embodiment, the connection between the front curved edges 442 of the wing portions 44 and the periphery of the front convex portion 431, the connection between the wing lateral edges 441 of the wing portions 44, and the connection between the rear mating edges 443 of the wing portions 41 may be accomplished by an ultrasonic welding method.

The waterproof unit 42 includes a first waterproof strip 421 and two second waterproof strips 422. The first waterproof strip 421 is fixedly connected to and covers the moisture-permeable waterproof layer 414 (see FIG. 4) or the outer surface of the sleeve body 41 at a position corresponding to the junction of the wing lateral edges 441 and the junction of the rear mating edges 443 of the wing portions 41. The first waterproof strip 421 extends from a front end to a rear end of the low-top shoe-like sleeve 40.

Figure 2:
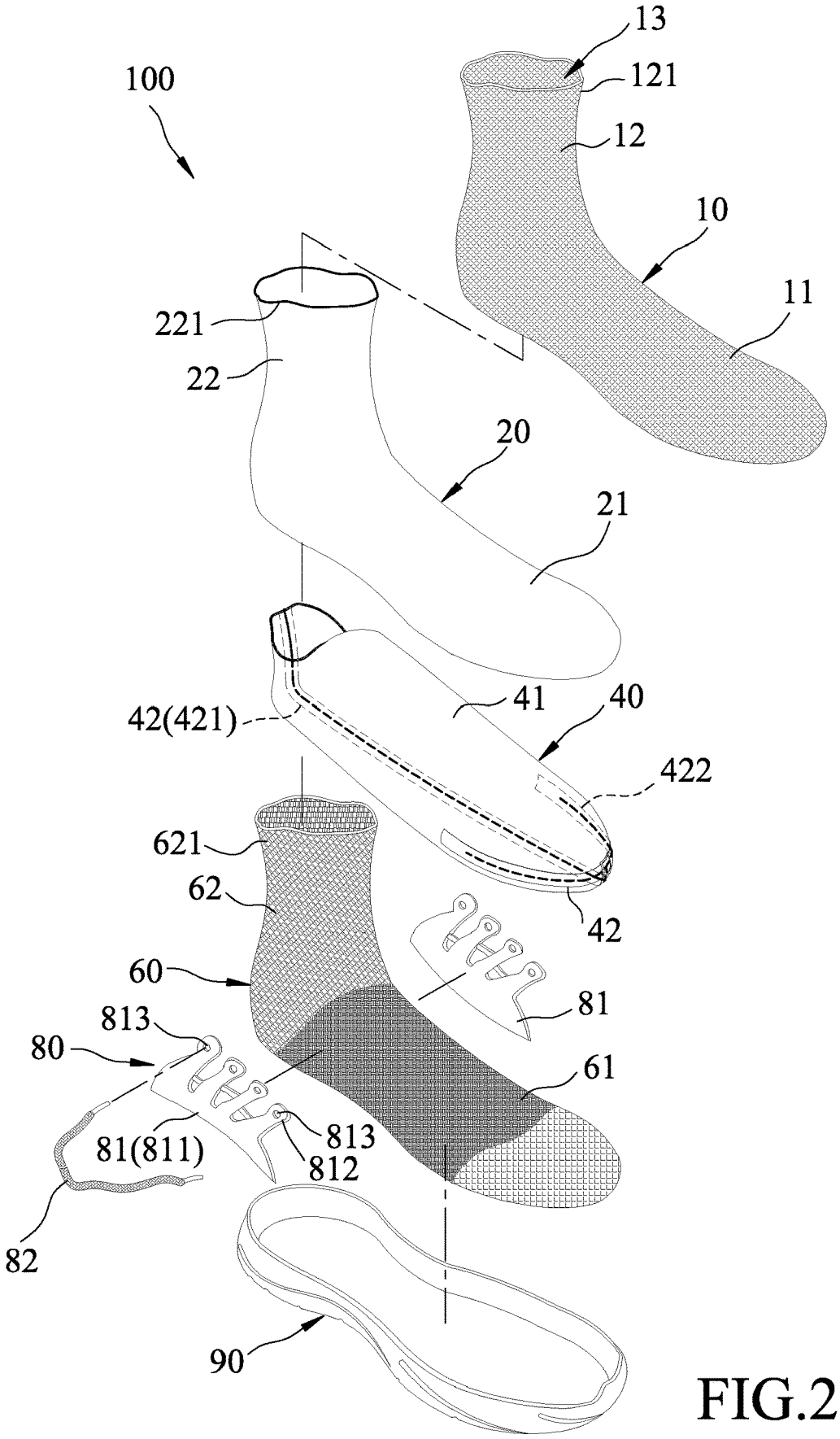
FIG. 2 is an exploded perspective view of the embodiment.

Each second waterproof strip 422 is fixedly connected to and covers the moisture-permeable waterproof layer 414 or the outer surface of the sleeve body 41 at a position corresponding to the junction of the front curved edge 442 of each wing portion 44 and the periphery of the front convex portion 431, as shown in FIGS. 2 and 9. The second waterproof strips 422 interlace with a front end of the first waterproof strip 421.

Figure 4:
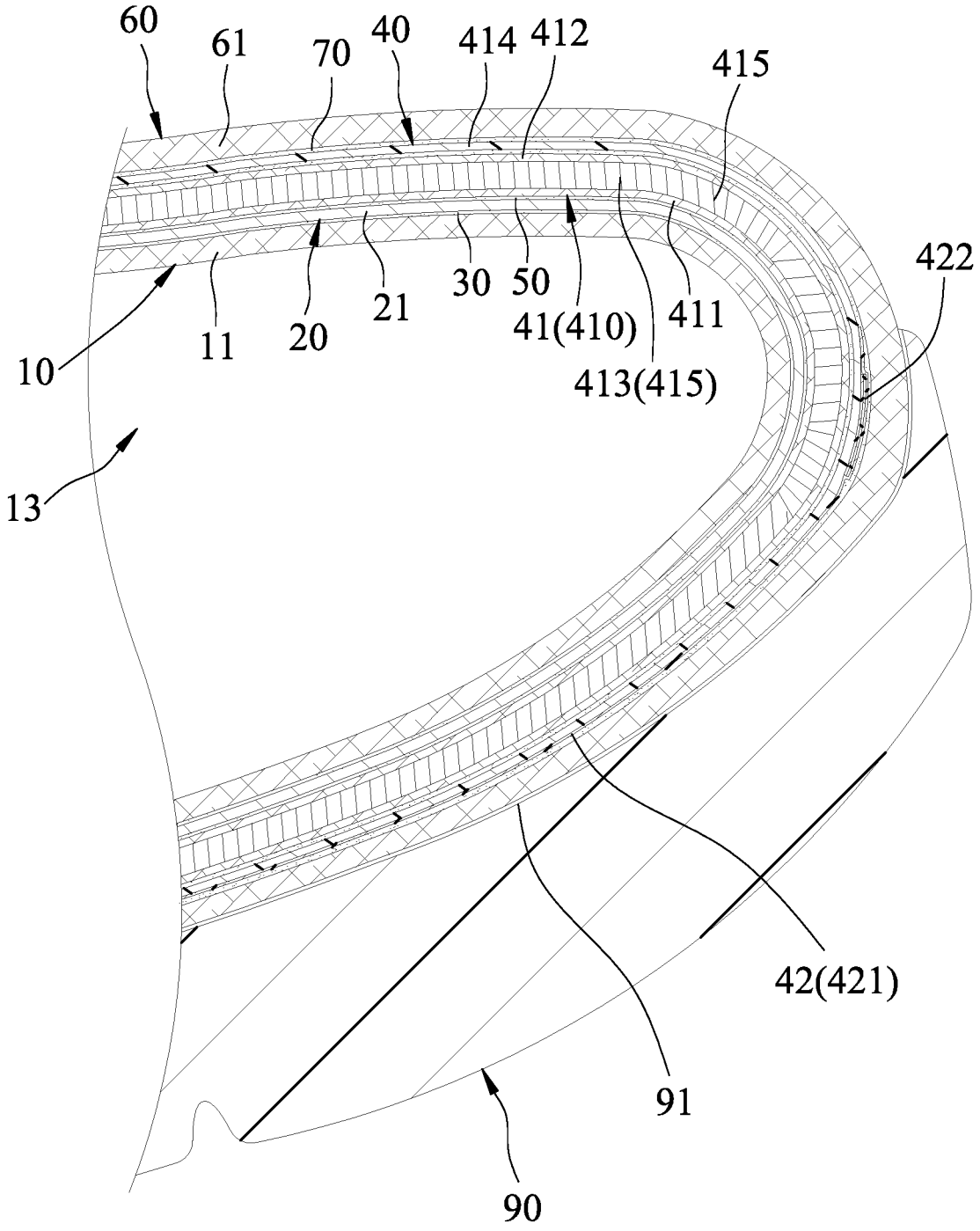
FIG. 4 is an enlarged fragmentary sectional view of the embodiment.
Figure 5:
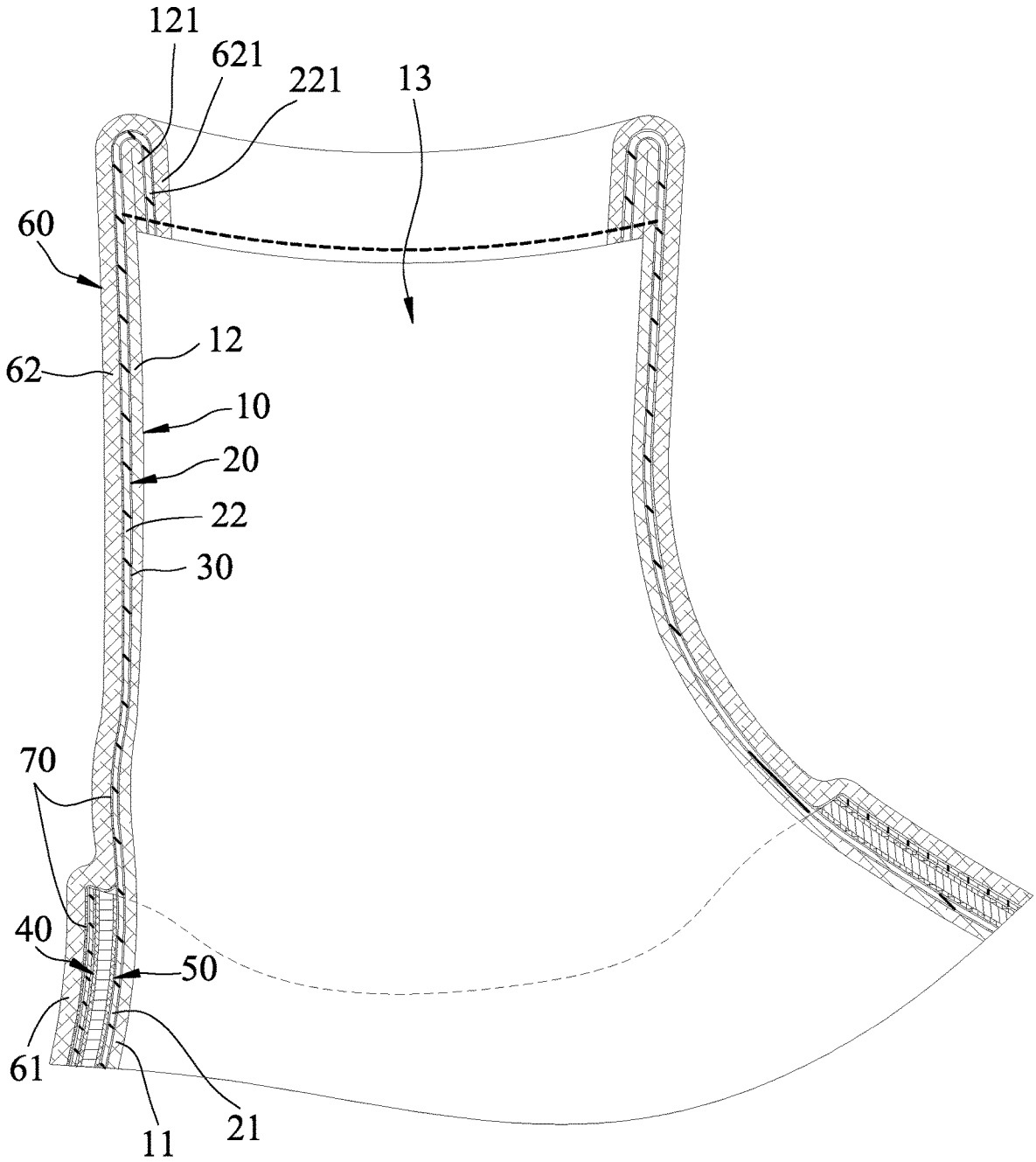
FIG. 5 is another enlarged fragmentary sectional view of the embodiment.

As shown in FIGS. 4 and 5, the second connecting layer 50 is fixed between the outer surface of the second foot portion 21 and the lining layer 411 or the inner surface of the sleeve body 41. In this embodiment, the second connecting layer 50 is hot-melt adhesive, and is sprayed completely on the outer surface of the second foot portion 21 and the inner surface of the sleeve body 41. In other variations of this embodiment, the second connecting layer 50 may be sprayed partially on the outer surface of the second foot portion 21 and the inner surface of the sleeve body 41, or coated on the outer surface of the second foot portion 21 and the inner surface of the sleeve body 41 by glue dispensing.

The high-top outer sock body 60 is sleeved on an assembly of the high-top inner sock body 10, the high-top shoe-like sleeve 20 and the low-top shoe-like sleeve 40. The high-top outer sock body 60 includes a third foot portion 61 corresponding to the second foot portion 21, and a third leg portion 62 extending upwardly from the third foot portion 61 and corresponding to the second leg portion 22. The third leg portion 62 has a third top end 621 corresponding to the second top end 221. In this embodiment, the high-top outer sock body 60 has a height (H) measured from a top end of the third leg portion 62 to a bottom end of the third foot portion 61 that is not less than 15 cm. The high-top outer sock body 60 is a woven sock, but is not limited thereto.

Figure 3:
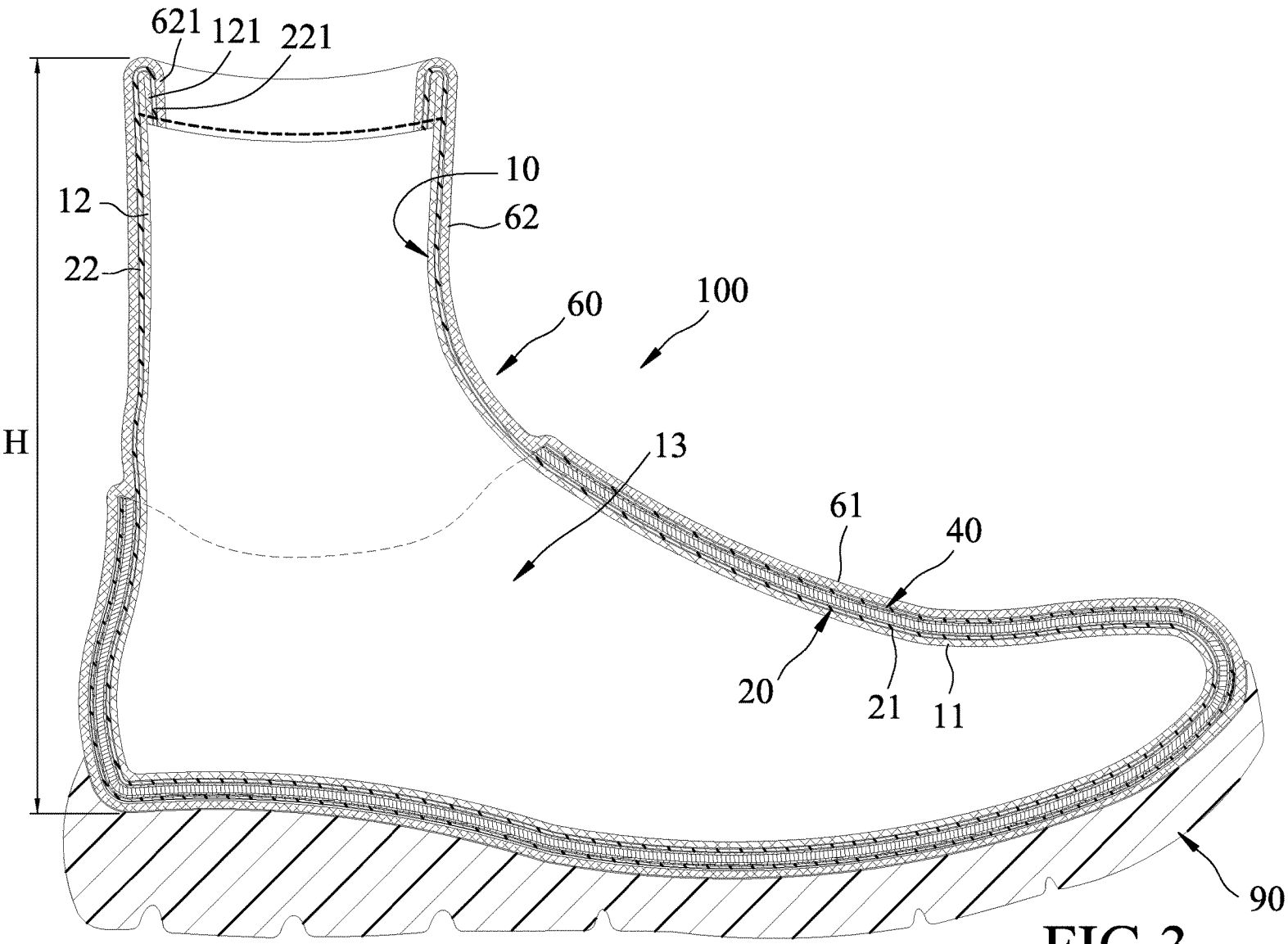
FIG. 3 is an assembled sectional view of the embodiment.

As shown in FIGS. 3 and 5, the first top end 121, the second top end 221 and the third top end 621 are stacked one behind the other, are inwardly folded into the foot space 13, and are fixed to the inner surface of the first leg portion 12 by sewing.

As shown in FIGS. 4 and 5, the third connecting layer 70 is fixed between the outer surface of the sleeve body 41 and an inner surface of the third foot portion 61 and between an outer surface of the second leg portion 22 and an inner surface of the third leg portion 62. In this embodiment, the third connecting layer 70 is hot-melt adhesive, and is sprayed completely on the outer surface of the sleeve body 41, the inner surface of the third foot portion 61, the outer surface of the second leg portion 22 and the inner surface of the third leg portion 62. In other variations of this embodiment, the third connecting layer 70 maybe sprayed partially on the outer surface of the sleeve body 41, the inner surface of the third foot portion 61, the outer surface of the second leg portion 22 and the inner surface of the third leg portion 62; or coated on the outer surface of the sleeve body 41, the inner surface of the third foot portion 61, the outer surface of the second leg portion 22 and the inner surface of the third leg portion 62 by glue dispensing.

As shown in FIGS. 1 and 2, the tightening unit 80 includes two decorative tightening plates 81 symmetrically disposed on left and right sides of the third foot portion 61 and connected to the sole 90, and a tightening strap 82 interconnecting the decorative tightening plates 81. Each decorative tightening plate 81 has a bottom end portion 811 connected to the sole 90, and a top end portion 812 connected to the tightening strap 82. In this embodiment, the top end portion 812 is formed with a plurality of spaced-apart through holes 813. The tightening strap 82 is a shoelace that is removably threaded through the through holes 813 in the tightening plates 81.

As shown in FIGS. 3 and 4, the sole 90 is fixed to a bottom portion of the third foot portion 61. In this embodiment, the adhesive layer 91 is fixed between a top portion of the sole 90 and the bottom portion of the third foot portion 61.

As shown in FIGS. 6 to 9, a method of making the low-top shoe-like sleeve 40 is briefly described below, but is not limited thereto.

The first step is to adhere a moisture-permeable waterproof membrane (not shown) on an outer surface of a fabric (not shown) having a three-layer structure using an adhesive.

The second step is to cut the fabric to obtain the cut piece 410.

The third step is to form the cut piece 410 into the sleeve body 41 of the low-top shoe-like sleeve 40 having a three-dimensional shape by sewing, or alternatively, by an ultrasonic welding method.

The fourth step is to adhere the first waterproof strip 421 and the second waterproof strips 422 to the seams so as to cover the same.

Through this, the making of the low-top shoe-like sleeve 40 is completed.

From the foregoing, the advantages of this disclosure can be summarized as follows:

1) The first leg portion 12 and the third leg portion 62 have flexibility, so that it is easy for the user to wear and remove the high-top shoe 100 of this disclosure. In comparison with the prior art, the high-top shoe 100 of this disclosure does not need to be provided with a conventional side zipper, so that wearing comfort can be effectively enhanced.

2) When the high-top shoe 100 of this disclosure is worn by the user, through the configurations of the high-top shoe-like sleeve 20 and the low-top shoe-like sleeve 40, moisture in the user's foot can be sequentially discharged through the high-top shoe-like sleeve 20, through gaps among the pile yarns 415 of the upright velvet layer 413, and through the lining layer 411, the outer fabric layer 412 and the moisture-permeable waterproof layer 414 of the sleeve body 41. Hence, the high-top shoe 100 of this disclosure has a good moisture-permeable effect.

3) Through the configurations of the high-top shoe-like sleeve 20 and the moisture-permeable waterproof layer 414 of the sleeve body 41, two levels of waterproof protection can be provided to effectively prevent external moisture from penetrating into the interior of the high-top shoe 100, thereby providing a good waterproof effect on the user's foot during wear of the high-top shoe 100.

In summary, the high-top shoe 100 of this disclosure not only is convenient for the user to wear and remove, but also has a good moisture permeability, and can provide two levels of waterproof protection, so that the high-top shoe 100 can permit the user to feel comfortable during wear thereof. Therefore, the object of this disclosure can indeed be achieved.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A zipper-free moisture-permeable waterproof high-top shoe comprising:

a high-top inner sock body including a first foot portion, and a first leg portion extending upwardly from said first foot portion and cooperating with said first foot portion to define a foot space having a top opening;

a moisture-permeable waterproof high-top shoe-like sleeve sleeved on said high-top inner sock body and including a second foot portion corresponding to said first foot portion, and a second leg portion extending upwardly from said second foot portion and corresponding to said first leg portion;

a moisture-permeable waterproof low-top shoe-like sleeve sleeved on said second foot portion and including a sleeve body made from at least one cut piece which includes a lining layer, an outer fabric layer, an upright velvet layer and a moisture-permeable waterproof layer, said lining layer serving as an inner surface of said sleeve body and being connected to an outer surface of said second foot portion, said upright velvet layer having a plurality of spaced-apart pile yarns woven between said lining layer and said outer fabric layer said moisture-permeable waterproof layer serving as an outer surface of said sleeve body and being fixed to an outer surface of said outer fabric layer;

a high-top outer sock body sleeved on an assembly of said high-top inner sock body, said high-top shoe-like sleeve and said low-top shoe-like sleeve, said high-top outer sock body including a third foot portion corresponding to said second foot portion, and a third leg portion extending upwardly from said third foot portion and corresponding to said second leg portion; and a sole fixed to a bottom portion of said third foot portion.

2. The zipper-free moisture-permeable waterproof high-top shoe as claimed in claim 1, further comprising a first connecting layer, a second connecting layer and a third connecting layer, said first connecting layer being fixed between an outer surface of said high-top inner sock body and an inner surface of said high-top shoe-like sleeve, said second connecting layer being fixed between an outer surface of said second foot portion and said inner surface of said sleeve body, said third connecting layer being fixed between said outer surface of said sleeve body and an inner surface of said third foot portion and between an outer surface of said second leg portion and an inner surface of said third leg portion.

3. The zipper-free moisture-permeable waterproof high-top shoe as claimed in claim 1, wherein said first leg portion has a first top end defining said top opening of said foot space, said second leg portion having a second top end corresponding to said first top end, said third leg portion having a third top end corresponding to said second top end, and wherein said first, second and third top ends are stacked one behind the other, are inwardly folded into said foot space, and are fixed to said inner surface of said first leg portion by sewing.

4. The zipper-free moisture-permeable waterproof high-top shoe as claimed in claim 1, wherein:

said cut piece has a main body, and two wing portions symmetrically disposed on two opposite sides of said main body and integrally connected as one piece with said main body, said main body having a front convex portion and a rear concave portion opposite to said front convex portion, each of said front convex portion and said rear concave portion having two opposite ends;

each of said wing portions includes a wing lateral edge spaced apart from said main body and having a front end and a rear end, a front curved edge connected between said front end of said wing lateral edge and a corresponding one of said two opposite ends of said front convex portion, and a rear mating edge connected between said rear end of said wing lateral edge and a corresponding one of said two opposite ends of said rear concave portion;

said front curved edges of said wing portions are connected to a periphery of said front convex portion, said wing lateral edges of said wing portions are connected to each other, and said rear mating edges of said wing portions are connected to each other, thereby forming said sleeve body; and said low-top shoe-like sleeve further includes a waterproof unit fixedly connected to and covering said outer surface of said sleeve body at positions corresponding to the junction of said front curved edges and the periphery of said front convex portion, the junction of said wing lateral edges, and the junction of said rear mating edges.

5. The zipper-free moisture-permeable waterproof high-top shoe as claimed in claim 4, wherein said waterproof unit includes a first waterproof strip and two second waterproof strips, said first waterproof strip being fixedly connected to and covering said outer surface of said sleeve body at a position corresponding to the junction of said wing lateral edges and said junction of said rear mating edges, each of said second waterproof strips being fixedly connected to and covering said outer surface of said sleeve body at a position corresponding to the junction of said front curved edge of each of said wing portions and the periphery of said front convex portion, said second waterproof strips interlacing with a front end of said first waterproof strip.

6. The zipper-free moisture-permeable waterproof high-top shoe as claimed in claim 2, further comprising a tightening unit which includes two decorative tightening plates symmetrically disposed on left and right sides of said third foot portion and connected to said sole, and at least one tightening strap interconnecting said decorative tightening plates, each of said decorative tightening plates having a bottom end portion connected to said sole, and a top end portion connected to said tightening strap.

7. The zipper-free moisture-permeable waterproof high-top shoe as claimed in claim 6, wherein said top end portion of each of said decorative tightening plates is formed with a plurality of spaced-apart through holes, and said at least one tightening strap is a shoelace that is removably threaded through said through holes in said tightening plates.

8. The zipper-free moisture-permeable waterproof high-top shoe as claimed in claim 1, wherein said high-top outer sock body has a height measured from a top end of said third leg portion to a bottom end of said third foot portion that is not less than 15 cm.

9. The zipper-free moisture-permeable waterproof high-top shoe as claimed in claim 1, further comprising an adhesive layer for fixing said sole to said bottom portion of said third foot portion.

* * * * *